US005492058A

United States Patent [19]

Greive

[11] Patent Number: 5,492,058

[45] Date of Patent: Feb. 20, 1996

[54] SEALING DEVICE FOR AN OFFSET PRINTING MACHINE

[75] Inventor: Martin Greive, Leimen, Germany

[73] Assignee: Heidelberger Druckmaschinen AG, Heidelberg, Germany

[21] Appl. No.: 200,923

[22] Filed: Feb. 22, 1994

Related U.S. Application Data

[63] Continuation of Ser. No. 892,419, Jun. 1, 1992, abandoned, which is a continuation of Ser. No. 518,549, May 3, 1990, abandoned.

[30] Foreign Application Priority Data

May 3, 1989 [DE] Germany ..... 39 14 647.2

[51] Int. Cl.[6] ..... B41F 7/32; B41L 25/12

[52] U.S. Cl. ..... 101/148; 101/350

[58] Field of Search ..... 101/207, 210, 101/132.5, 147, 148, 323, 350, 363, 364

[56] References Cited

U.S. PATENT DOCUMENTS

| | | | |
|---|---|---|---|
| 2,887,049 | 5/1959 | Mueller | 101/364 |
| 2,945,437 | 7/1960 | Hilgoe et al. | 101/364 |
| 3,589,287 | 6/1971 | Woessner | 101/363 |
| 3,604,349 | 9/1971 | Sejeck et al. | 101/148 |
| 3,769,909 | 11/1973 | Fugman et al. | 101/148 |
| 4,414,897 | 11/1983 | Sato et al. | 101/350 |
| 4,455,938 | 6/1984 | Loudon | 101/148 |

FOREIGN PATENT DOCUMENTS 0047350 3/1982 European Pat. Off. .

*Primary Examiner*—Stephen Funk

*Attorney, Agent, or Firm*—Herbert L. Lerner; Laurence A. Greenberg

[57] ABSTRACT

Sealing device for a dampening unit of an offset printing machine having a dampening-medium applicator roller and a metering roller rolling on one another so that a duct for receiving a supply of dampening medium therein is formed by an upper wedge located between the metering roller and the applicator roller, and having a sealing support bracket mountable on a lateral part of the dampening unit pre-stressed in a direction towards an end face of the rollers, and a sealing element held by the sealing support bracket and sealingly supported radially on the metering roller and sealingly engaging the end face of the dampening-medium applicator roller. A path is defined for swivelling the sealing element into a make-ready position wherein the sealing element is removable from the sealing device, the path being left free by the sealing support bracket so that the sealing element may be turned about the metering roller.

16 Claims, 6 Drawing Sheets

SEALING DEVICE FOR AN OFFSET PRINTING MACHINE

CROSS-REFERENCE TO RELATED APPLICATIONS:

This is a continuation of application Ser. No. 07/892,419, filed Jun. 1, 1992, now abandoned; which was a continuation of application Ser. No. 07/518,549, filed May 3, 1990, now abandoned.

BACKGROUND OF THE INVENTION

1. Field of the Invention

The invention relates to a sealing device for a dampener of an offset printing machine and more particularly to a sealing device for a dampener having a metering roller and an applicator roller. The applicator roller and the metering roller roll on one another in a way that, with an upper wedge shaped nip between these rollers, they form a channel or duct which can accommodate a supply of dampening medium. The sealing device seals the channel or duct at the end faces. Specifically, the sealing device has a sealing support bracket which is mountable on a lateral part of the dampening unit, and in which a sealing element is accommodated. The seal support bracket is pre-stressed against an end face of the rollers, the sealing element being sealingly supported radially on the metering roller, and sealingly engaging the end face of the applicator roller.

2. Description of the Related Art

From German Published Non-Prosecuted Application (DE-OS) 22 06 498, it has become known heretofore how to accumulate a supply of dampening medium in the duct between the metering roller and the dampening-medium applicator roller, which roll on one another. With respect to the sealing device of this heretofore known dampener, a sealing element, formed of resilient sealing material, is applied to both end faces of the metering roller and the dampening applicator roller. The sealing element is further formed of a blocking plate, in which the resilient sealing material is accommodated. The blocking plate is held in an upwardly open guidance device, and can be removed in this direction for purposes of exchange. It is secured in position by catch projections or detents, which snap into corresponding catch recesses formed in the blocking plate.

From European Published Non-Prosecuted Application (EP-A1) 0 047 350, there has become known, with respect to a dampening unit, a sealing device having the features mentioned in the introduction hereto. The sealing element, accommodated in the sealing support bracket, is both axially and radially pre-stressed by spring tension in the case of this heretofore known sealing device. The sealing is thus achieved in two directions, i.e. at the end face of the dampening applicator roller, in the one direction, and at the outer cylindrical surface of the metering roller, in the other direction. The configuration of this heretofore known sealing device is far from satisfactory, particularly with regard to the necessary exchange of the sealing element, which is constructed as a wearing part. In the case of this heretofore known sealing device, an upper marginal region of the sealing element is subjected to the action of a bracing or supporting spring, which is braced against an angle-shaped part overlapping the marginal region of the sealing element. This has an adverse effect upon accessibility, and makes the task of exchanging more difficult, which has been found to be time-consuming.

SUMMARY OF THE INVENTION

It is accordingly an object of the invention to provide a sealing device which affords a reliable sealing of the channel or duct accommodating the supply of dampening medium, and simultaneously, an operator-friendly exchange of the sealing element.

With the foregoing and other objects in view, there is provided, in accordance with the invention, a sealing device for a dampening unit of an offset printing machine having a dampening-medium applicator roller and a metering roller, rolling on one another so that a duct for receiving a supply of dampening medium therein is formed by an upper wedge located between the metering roller and the applicator roller, and having a sealing support bracket mountable on a lateral part of the dampening unit and pre-stressed in a direction towards an end face of the rollers, and a sealing element held by the sealing support bracket and sealingly supported radially on the metering roller and sealingly engaging the end face of the dampening-medium applicator roller, comprising means defining a path for swivelling the sealing element into a make-ready position wherein the sealing element is removable from the sealing device, the path being left free by the sealing support bracket so that the sealing element may be turned about the metering roller.

In accordance with another feature of the invention, the sealing element is formed with a gripper extension.

In accordance with a further feature of the invention, there is provided a support projection formed on the sealing support bracket, the support projection being located outside an area brushed by the sealing element on the swivelling path thereof.

In accordance with an added feature of the invention, the sealing element is in cooperative engagement with a displaceable security member having means for applying pressure in a pre-stressed manner to a lateral surface of the sealing element.

In accordance with an additional feature of the invention, the lateral surface of the sealing element extends substantially tangentially to the circumference of the metering roller.

In accordance with again another feature of the invention, the security member is a plate having a boundary edge forming a first wedge surface and a second wedge surface, the wedge surfaces being located opposite one another, the first wedge surface being in cooperative engagement with the lateral surface of the sealing element, and the second wedge surface being in cooperative engagement with a cam fixed in position with respect to the sealing device.

In accordance with again a further feature of the invention, there are provided means for applying spring pressure from below to the security member, the applied spring pressure acting substantially parallel to the first wedge surface which is in cooperative engagement with the lateral surface of the sealing element.

In accordance with again an added feature of the invention, there is provided a spring mounted on the lateral part of the dampening unit, the spring having a leg engaging in a receiving groove formed in the security member.

In accordance with again an additional feature of the invention, the security member is formed with a receiving pocket, and the security member is displaceable in a downward direction, the cam being received in the receiving pocket when the security member is displaced in the downward direction.

In accordance with yet another feature of the invention, the security member has at least one overlap projection in an upper region thereof, the overlap projection projecting beyond a lateral surface of the security member and extending over the lateral part of the dampening unit.

In accordance with yet a further feature of the invention, the overlap projection projects beyond both lateral surfaces of the security member.

In accordance with yet an added feature of the invention, the sealing support bracket is mounted swivellably on the lateral part of the dampening unit.

In accordance with yet an additional feature of the invention, there is provided a pin fixed with respect to the lateral part of the dampening unit and extending parallel to the axes of the metering and application rollers, the sealing support bracket being mounted so as to swivel about the pin.

In accordance with still another feature of the invention, the sealing support bracket is formed with a downwardly opening bearing hook, the bearing hook being in cooperative engagement with the pin bearing the sealing support bracket.

In accordance with still a further feature of the invention, the pin is disposed above the circumference of the metering roller, and the bearing hook is formed on a lateral end of the sealing support bracket facing towards the metering roller.

In accordance with still an added feature of the invention, the sealing support bracket for the sealing element is formed with a guide surface, and the pin projects beyond the guide surface.

In accordance with still an additional feature of the invention, the sealing element is formed with a region of greater thickness above the duct, the region being on a side thereof facing towards the duct.

In accordance with a concomitant feature of the invention, the region of greater thickness extends, substantially radially with respect to the metering roller, beyond the sealing element, and forms a gripper extension.

According to the invention, the sealing support bracket leaves a path free for swivelling the sealing element into a make-ready position for removal. The sealing element can be swivelled by turning it about the metering roller into the make-ready position for removal. Due to this configuration, the assembly and also the subsequent exchanging of the sealing element can be performed in an extremely simple manner. Necessary support projections are not provided in an area brushed by the sealing element as it swivels about the metering roller. In order for the sealing element to be able to swivel simply into the make-ready position for removal, it is preferable for the sealing element to have a gripper extension.

The metering roller is also used as a "pivot pin". This not only means that special guidance devices can be dispensed with but also produces the advantage of the automatic resetting of the sealing element as wear increases during operation.

The end-face sealing surface, which cooperates with the dampening applicator roller, has a tendency, because of the direction of rotation of the dampening applicator roller and the prevalent frictional force, to draw the sealing element in a direction opposite to the direction of release. In order to create a stop for the sealing element in this direction, so as to prevent the sealing element from being moved out of the sealed area in a downwards direction, it is preferably provided that a support projection be formed on the sealing support bracket, which is located outside of an area brushed by the sealing element on the swivelling path. This support projection effectively forms a stop for the sealing element downwardly, but does not prevent swivelling of the sealing element about the metering roller for the purposes of assembly or exchanging the sealing element.

In order to secure the sealing element in the sealing position, it is further preferably provided that a lateral surface of the sealing element cooperates with a security or safety member which acts upon the lateral surface. The security member is, for example, held in its position on the lateral surface by means of a spring. The movable positioning of the security-member permits the security member to remain in contact with the sealing element in the event that the sealing element moves, as a result of wear, in a substantially downward direction. If there is a stoppage of the machine, due to which, as a result of elastic deformations occurring during operation in the dampening applicator roller, a resetting can occur which has a tendency towards turning the sealing element out of its sealing position, then a reverse movement of this sort by the sealing element is effectively prevented. The lateral surface, on which the security member acts, extends approximately tangentially to a circumference of the metering roller.

Because the security member is intended to prevent an undesired swivelling movement of the sealing element in the direction of the make-ready position for removal, it is understood that the lateral surface of the sealing element, with which the security member cooperates, is aligned in such a way that the security member not only prevents a movement by the sealing element in a vertically upwards direction, but also a swivelling movement by the sealing element about the metering roller, as long as the security member engages the relevant lateral surfaces of the sealing element.

It is further preferable for the security member to be constructed as a plate with a substantially wedge-shaped marginal edge. One wedge surface, which lies opposite a wedge surface cooperating with the lateral surface of the sealing element, cooperates with a cam having a fixed position with respect to the sealing device. The wedge-shaped constructs permits, in a relatively simple way, the required mobility of the security member, in order to allow resetting in the event the sealing element migrates as a result of wear. By means of the cooperation of one of the wedge surfaces with a fixed cam, the security member can also automatically reset itself in full surface contact on the lateral surface of the sealing element if there is a possibly overlapping rotational movement of the sealing element resulting from wear. It is understood that, for this purpose, the cam has a rounded circumferential area which cooperates with the wedge surface.

With regard to the required prestressing with which the security member acts upon the lateral surface of the sealing element, it is further preferably provided that this be achieved by means of a spring which acts from below on the security member, substantially parallel to the wedge surface cooperating with the lateral surface of the sealing element. A force acting in this direction, if it acts directly on the sealing element, would attempt to turn the sealing element out of its sealing position by affecting the lateral surface. Due to the selected wedge-shaped construction of the security member and the cooperation of the one wedge surface with the described cam, however, an advantageous action results whereby a wear-related downward migration of the sealing element is not impaired but, simultaneously, the security member immediately compensates, by means of an upward movement, for a gap which would otherwise occur between the lateral surface of the sealing element and the facing wedge surface of the security member due to a migration movement by the sealing element. The spring which acts upon the security member is preferably secured on the lateral part of the dampening unit.

One leg of the spring fits into a receiving groove formed in the security member. By means of the receiving groove, this spring leg can also be trapped at the same time as the security member is engaged. The security member is constructed with a receiving pocket into which the cam, in effect, travels when there is a movement by the security member in a downwards direction. The security member is moved downwards when the sealing element is to be swivelled into its sealing position for assembly, or when the sealing element is to be swivelled into the make-ready position for removal for the purpose of exchange. When there is a downwards movement of the security member against the action of the spring force, a gap is created because of the tapering wedge between the lateral surface of the sealing element and the facing wedge surface of the security member. This gap is large enough to permit a swivelling of the sealing element about the metering roller.

It is, furthermore, preferable that, in its upper region, the security member be provided with an overlap projection which projects beyond a lateral surface of the security member, and extends over the lateral part of the dampening unit. This overlap projection prevents the security member from falling-through downwardly into the gap between the lateral part of the dampening unit and the end face of the dampening applicator roller when the sealing element has been removed. It is preferable for the overlap projection to be provided on both sides of the security member.

Above all, this has particular advantages in production or manufacture technology. With such a configuration, the same security member can be installed at both roller ends. Furthermore, the overlap projection on one side (but especially on both sides) also has handling advantages with regard to actuation of the security member for the purposes mentioned. Also, with respect to the positioning of the sealing support bracket itself, the sealing device is constructed to require the simplest possible handling, with an aim towards completely dispensing with any tool. Specifically, this is achieved by the sealing support bracket being (also) mounted so as to be swivellable on the lateral part of the dampening unit. This sealing support bracket thus becomes optimally accessible.

It proves favorable for the sealing support bracket to be mounted so that it can be swivelled about a pin parallel to the axes of the metering roller and the dampening applicator roller. The outward swivelling thus occurs without any obstacles in the narrow end face region of these rollers.

This configuration is optimized by the provision of a bearing bracket or hook on the sealing support bracket to cooperate with the pin. Thus, the removal is limited to simply unhinging the sealing support bracket.

It is furthermore favorable, from the viewpoint of coordination, for the bearing bracket or hook to be provided at an end of the sealing support bracket facing the metering roller, and furthermore, for it to be positioned above the circumference of the metering roller. In order to avoid the sealing element from crossing the zenith and turning towards the other side of the metering roller when the sealing element is turned about the metering roller, the pin is constructed so as to protrude beyond a guiding surface of the sealing support bracket, which is engaged by the broad side of the sealing element. A sort of double function of the pin is created, resulting in a limiting stop for the sealing element, which can thus be held in the highest position.

A further important feature of the invention is that the sealing element can have a region of greater thickness above the channel or duct, on the side facing towards the duct. It is preferable for this region of greater thickness to extend in a substantially radial direction with respect to the metering roller, past the sealing element to its manually accessible end. Either alone or in combination with the gripper extension mentioned further hereinabove, this region of greater thickness can contribute towards relative easy manipulation when removing the sealing element. It is advantageous to increase the gripping area. Furthermore, it is essential that a sealing element be individualized, due to this one-sided construction of the projection, with respect to the side on which it is to be installed in the dampening unit. Preferably, this region of greater thickness is continued through to the sealing area which cooperates with the metering roller. A further combined effect is thereby achieved because, the area of the sealing element located above the channel or duct is the area where, generally, the greatest attack by wear takes place.

Other features which are considered as characteristic for the invention are set forth in the appended claims.

Although the invention is illustrated and described herein as embodied in a sealing device for an offset printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
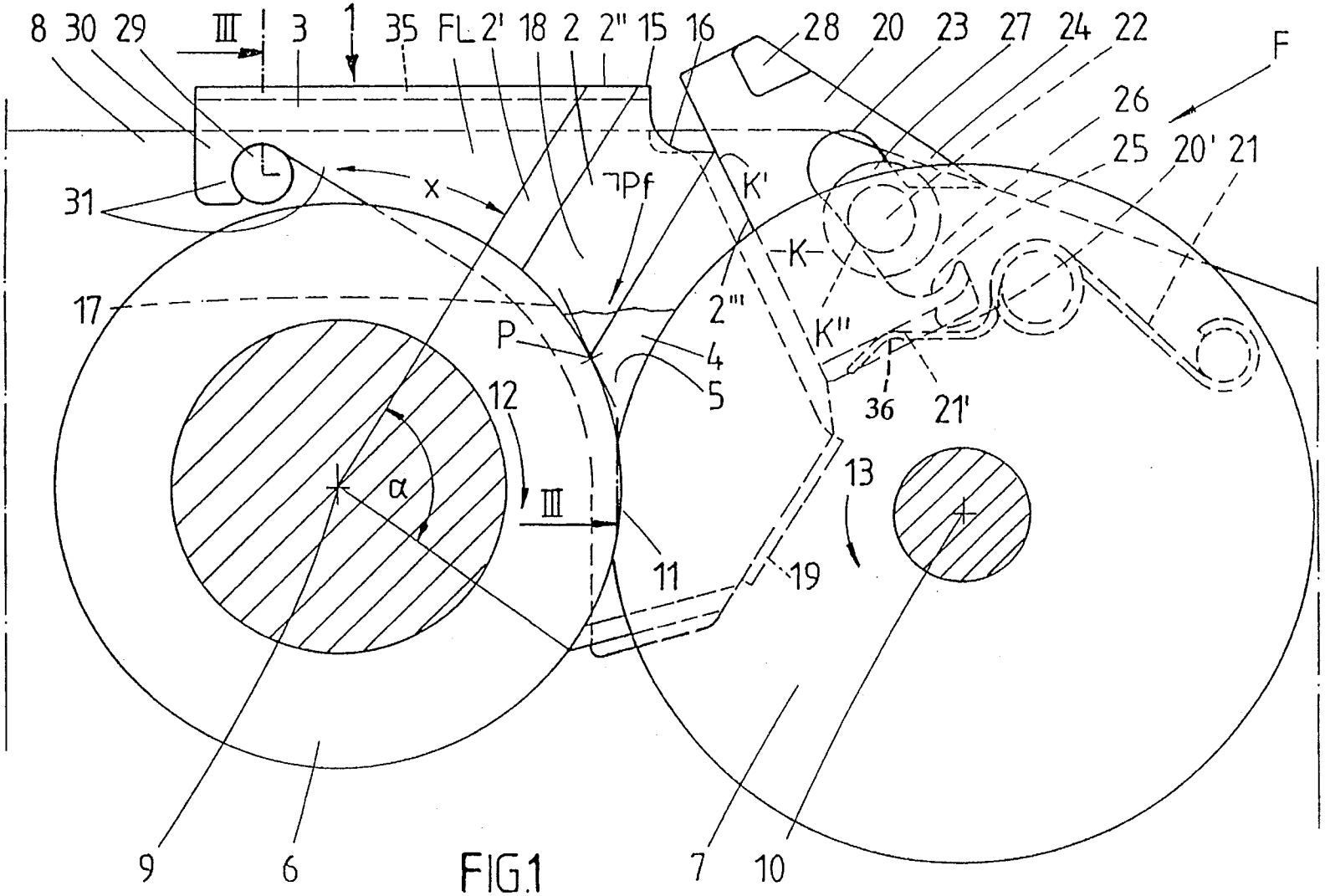
FIG. 1 is a vertical sectional view of an end region of a dampening unit incorporating the sealing device according to the invention.

Referring now to the figures of the drawing, there is shown therein, in particular, in FIGS. 1, 4, 5 and 6 thereof, a dampener or dampening unit F having a metering roller 6 and a dampening-medium applicator roller 7. The metering roller 6 and the dampening-medium applicator roller 7 roll against and on one another at a contact zone 11. An upper wedge, as viewed in FIG. 1, for example, which is defined thereby, forms a channel or duct 5, in which a supply of dampening medium 4 is accommodated. Specifically, the metering roller 6 and the dampening-medium applicator roller 7 are positioned and driven in such a manner that, in the contact zone in which the rollers 6 and 7 roll on one another, the respective circumferential velocities thereof are basically downwardly directed, as viewed in FIG. 1, for example.

Furthermore, the dampener F has a sealing device 1, which is formed of an actual sealing element 2 and a sealing support bracket 3 on which it is accommodated or held.

The metering roller 6 and the dampening-medium applicator roller 7 are mounted horizontally in the dampener F, as shown, for example, in FIG. 1. The dampener F is bounded by side members 8, only one of which, however, is shown in FIG. 1. The metering roller 6 has a somewhat smaller outer diameter than the dampening-medium applicator roller 7. Geometric axes 9 and 10, respectively, of the metering roller 6 and the dampening roller 7 are approximately at the same level. Because of the relatively rigid construction of the metering roller 6 and the more elastic construction of the dampening applicator roller 7, the latter roller 7 assumes a slightly concave shape at the contact zone 11.

The rotational direction of the metering roller 6 and the dampening applicator roller 7, respectively, in operating condition thereof is indicated by arrows 12 and 13. The cylindrical surface areas of the metering roller 6 and the dampening applicator roller 7 thus rotate downwardly at the contact area 11, as shown in FIG. 1.

The sealing element 2 (note also FIG. 2) is, in particular, constructed so that at an inner narrow side thereof, it is radially in sealing contact with an end region of the metering roller 6, and seals off the end face of the dampening-medium applicator roller 7 with the wide surface thereof turned towards the rollers 6 and 7. In the region of the contact area of the sealing element 2 with the metering roller 6 and the dampening-medium applicator roller 7, respectively, the sealing element 2 is of sharp-edged construction, in order to prevent the formation of a water ring on the dampening-medium applicator roller 7.

With respect to the radial sealing zone, the relevant end of the metering roller 6 has a respectively hardened and plasma-coated metal ring 14. Dampening medium reaching this metal ring 14 is guided by a bevel 2 formed at the upper end of the sealing element 2 into the duct 5, so as not to be flung away uncontrollably otherwise.

The sealing element 2 is formed of the material polytetrafluoroethylene (PTFE), for example. This material is advantageous both from the viewpoint of wear and with regard to its low tendency to accumulate dirt.

Regulating the level of the supply 4 of dampening medium in the duct 5 can be effected by conventional measures. Appropriate measures can be derived, for example, from the state of the art mentioned hereinbefore in the introduction hereto.

Figure 2:
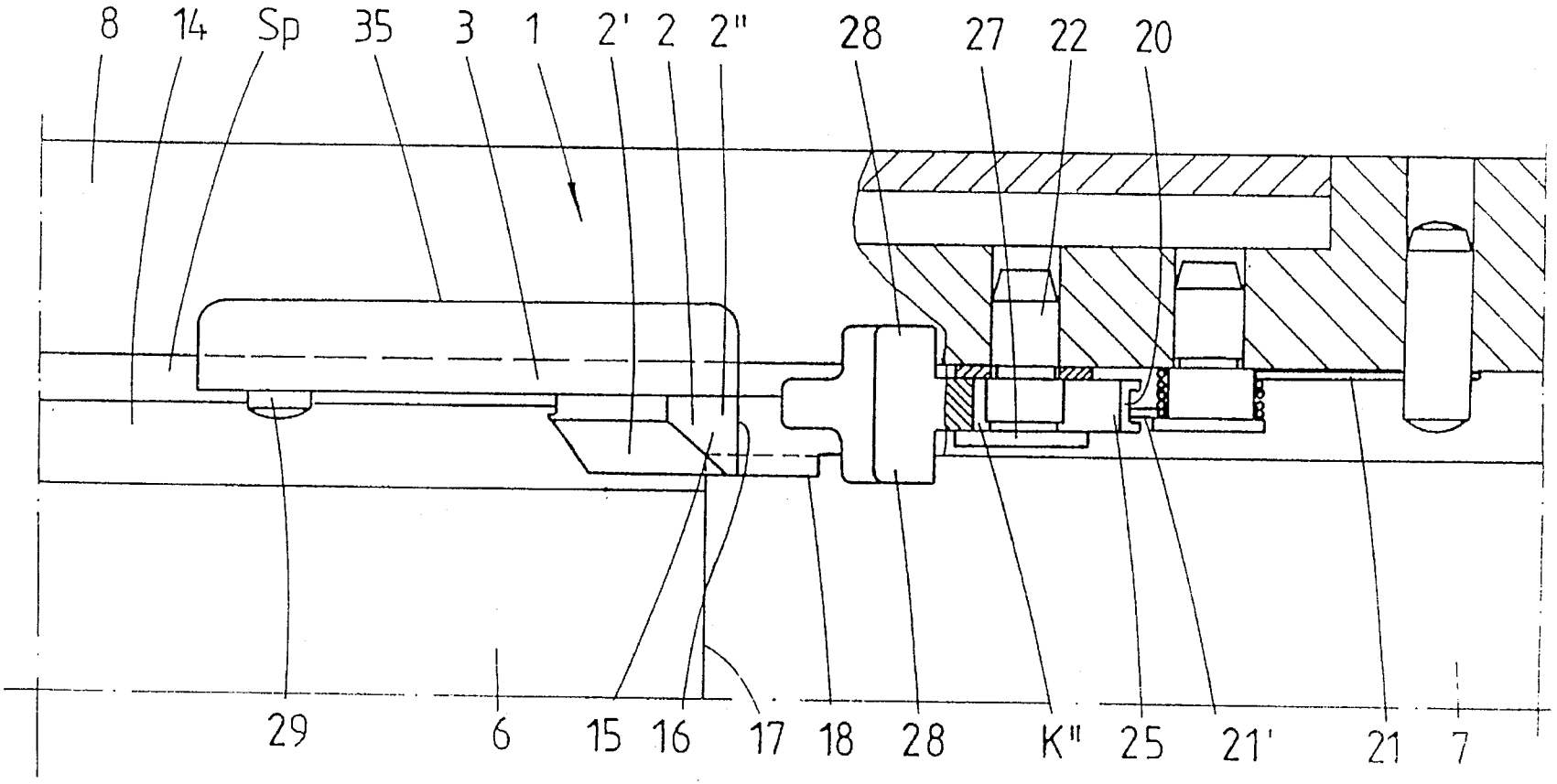
FIG. 2 is a top plan view of FIG. 1.
Figure 4:
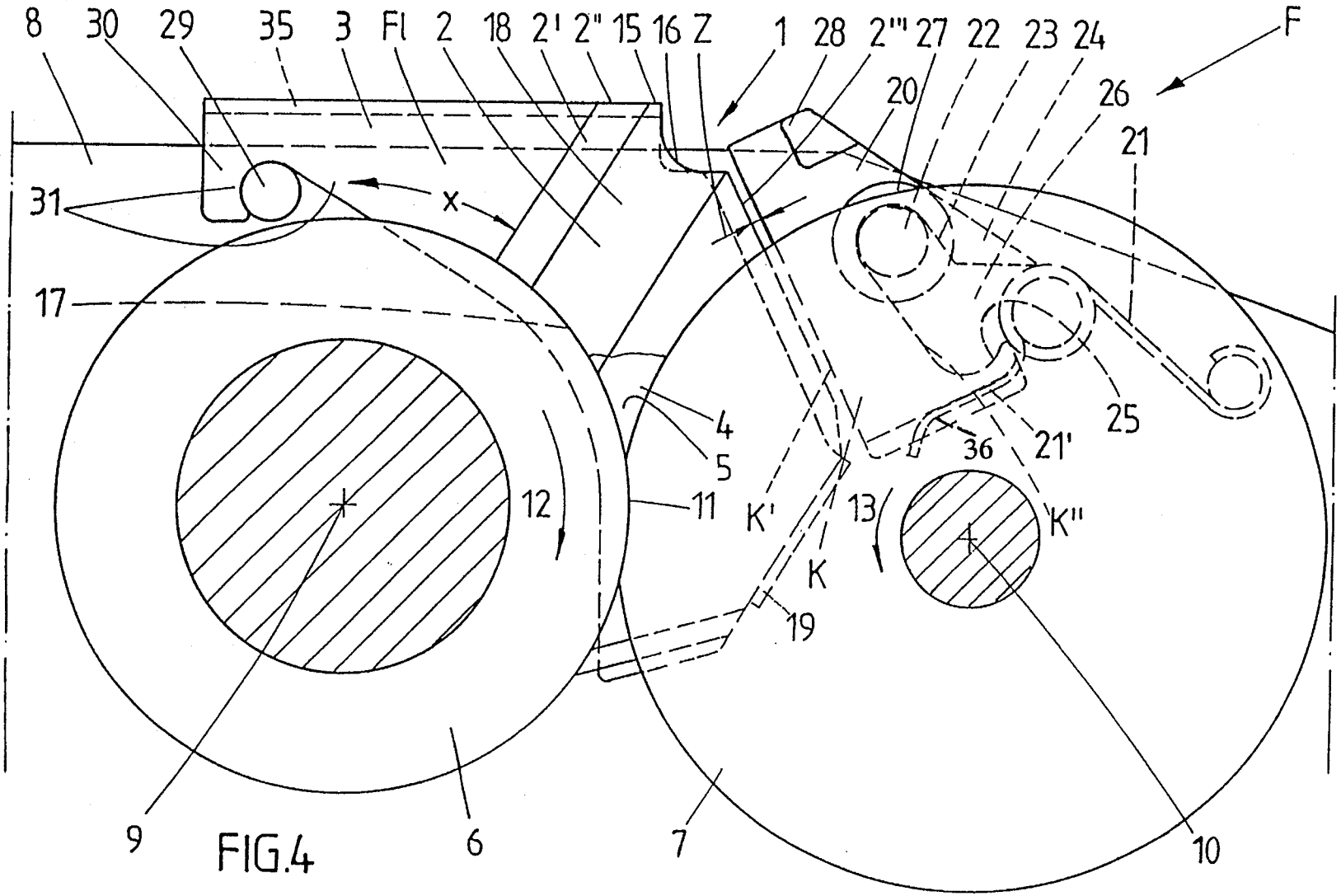
FIG. 4 is a view like that of FIG. 1 in another operating phase of the device wherein a safety or security member thereof is in pressed-down condition.
Figure 5:
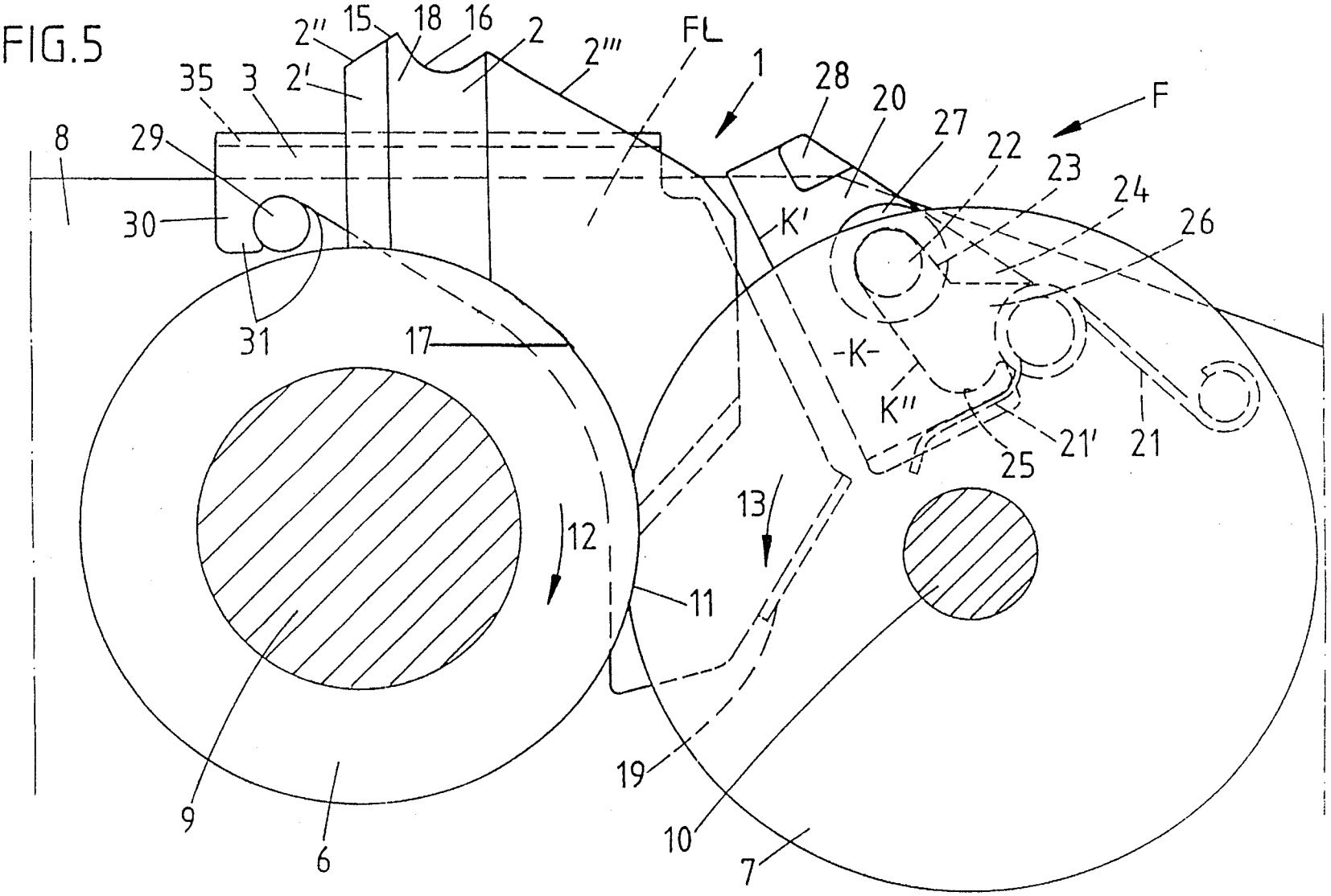
FIG. 5 is another view like that of FIG. 1 in a further operating phase of the device wherein a sealing element thereof has been turned into a made-ready position for removal.
Figure 6:
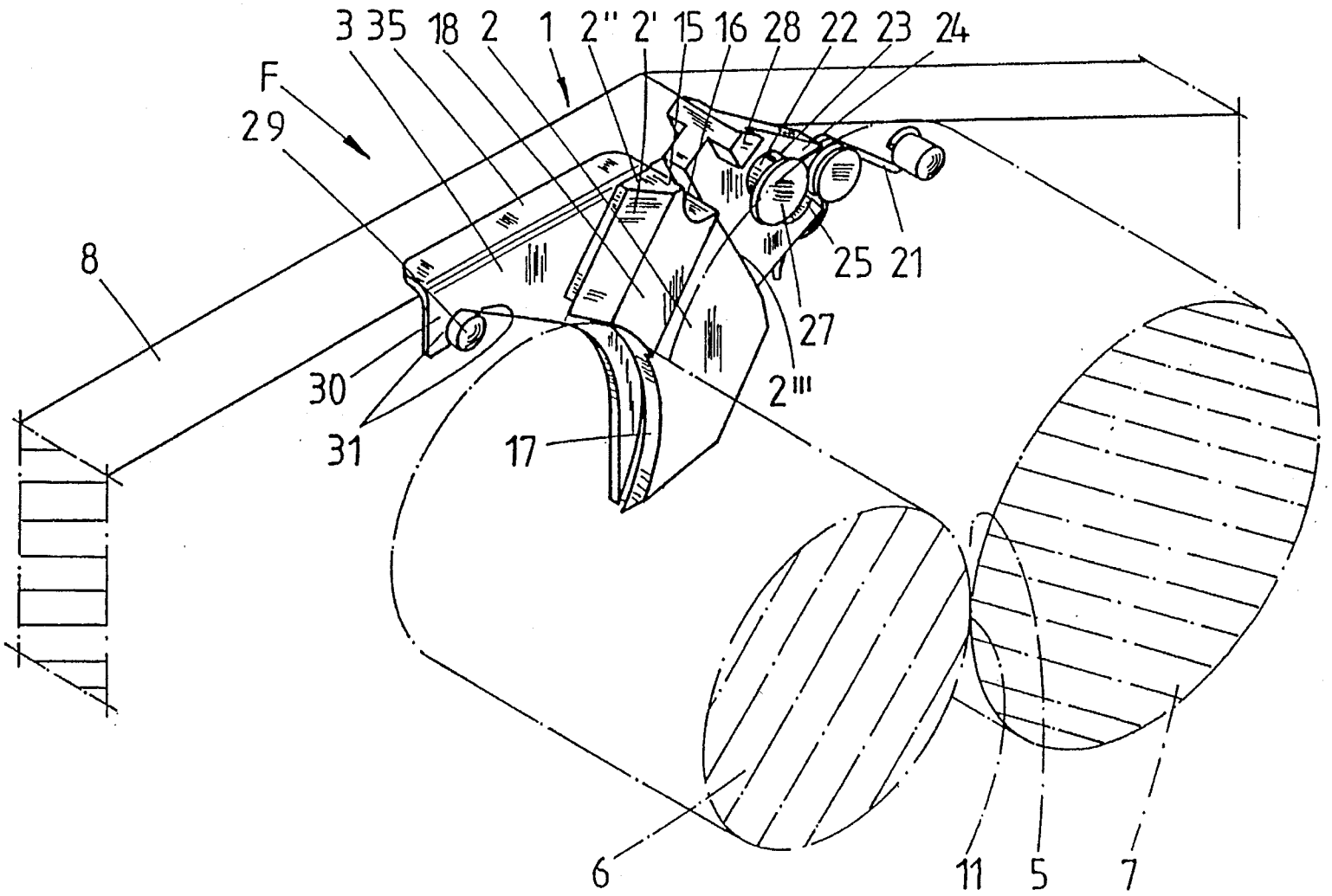
FIG. 6 is a perspective view of a sealing support bracket according to the invention which is equipped with the sealing element of FIG. 5 and cooperates with the safety or security member of FIG. 4, and with the metering roller and the applicator roller indicated in phantom.

The sealing element 2 is replaceable in a user-friendly manner. This is achieved by forming the sealing support bracket 3 so that it leaves free a swivel path x along which the sealing element 2 is swivellable into a mode-ready position for the removal thereof (note FIG. 5), the sealing element 2 being swivellable into that position by turning it about the metering roller 6. The sealing element 2 is supported on the metal ring 14 of the metering roller 6 in a form-locking or positive manner. While it is being turned, the sealing element 2 moves out of the functioning position thereof (FIG. 4) and into the make-ready position for removal (FIG. 5). To facilitate handling, the sealing element 2 is formed with an upwardly directed gripper extension 15, in the vicinity of an upwardly-directed lateral surface 2" thereof (FIG. 2). A finger-insert channel 16 is provided in a rear side of the gripper extension 15, and terminates in the lateral surface 2" which is disposed horizontally in the installed position thereof.

A support projection 19 is formed on the sealing support bracket 3 outside of an area brushed by the sealing element 2 on its swivelling path. The support projection 19 prevents the sealing element 2 from being moved farther downwardly than is provided for in the functional position thereof in FIG. 1, by the entraining dragging movement of the metering roller 6 and the dampening applicator roller 7, respectively.

The sealing element 2 further has a lateral surface 2''' lying somewhat opposite to the sealing area 17 and cooperating with a security or safety member 20. The security member 20, which has a substantially wedge-shaped construction, is pre-stressed upwardly by a spring 21, as viewed in FIG. 1. The spring 21 acts upon a lower lateral surface 20' of the security member 20. This lateral surface 20' is additionally formed with a groove 36, the spring 21 having a leg 21' lying in the groove 36.

The lateral surface 2''' of the sealing element 2 extends substantially tangentially to a circumference of the metering roller 6 and likewise tangentially (at a spaced distance) to the sealing area 17 of the sealing element 2, in such a way that a line perpendicular to and centrally intersecting the lateral surface 2''' passes approximately through a point P on the circumference of the metering roller 6, as shown in the drawing. The point P lies also approximately on a radial line, passing through the axis 9 of the metering roller 6, and enclosing with the horizontal, as viewed in FIG. 1, an angle of about 25 degrees.

The security or safety member 20 has a substantially wedge-shaped construction in the region K. The wedge surface K' cooperates with the lateral surface 2''' of the sealing element 2, while the wedge surface K" cooperates with a cam 22. The cam 22 is fixed on a lateral part 8 of the dampening unit F (also note FIG. 2).

The security or safety member 20 widens-out upwardly, forming a receiving pocket 23, into which the cam 22 travels when the security or safety member 20 is pressed downwardly. To form this pocket 23, the security member 20 is a portion continuous therewith and constituting an overlapping section 24, which lies opposite the wedge surface K". In a lower region of the wedge surface K", it merges with a receiving curvature 25, wherein the cam 22 comes to rest when the security member 20 is pressed fully upwards by the spring 21. With suitable manipulation, the security member 20 can be withdrawn, finally, from the cam 22 through the opening 26. According to FIG. 2, the cam 22 is formed, on an end thereof facing towards the dampening applicator roller 7, with a shoulder 27 which overlaps part of the security member 20. This shoulder 27 prevents the security member 20 from moving vertically to the lateral part 8 of the dampening unit F, as viewed in FIG. 2.

Figure 3:
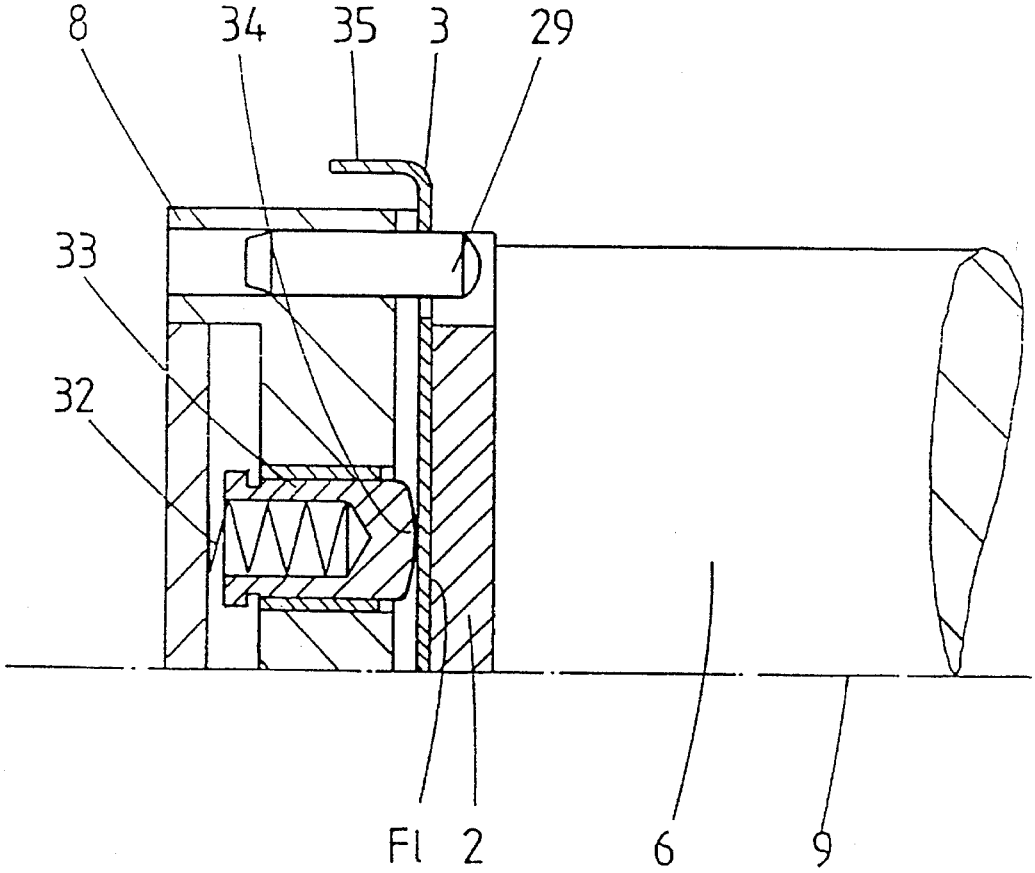
FIG. 3 is a cross-sectional view of FIG. 1, taken along the line III—III, in the direction of the arrows.

At its upper end, the security member 20, as shown in FIG. 1, for example, forms an overlap projection 28, which protrudes perpendicularly to an extended plane of the security member 20. This overlap projection 28 is formed on both sides of a plate-like portion forming the security member 20. When the sealing element 2 is removed, the overlap projection 28 prevents the security member 20 from tipping about the cam 22 and from slipping downwardly into a gap Sp located between the lateral part 8 and an end face of the dampening applicator roller 7. Due to the formation of the overlap projection 28 on both sides, of the security member 20, the latter can be used on both sides of the dampening unit F in the sealing device 1. The sealing support bracket 3 is formed with a guide surface FL for the sealing element 2 and can be swivelled around a pin 29 which extends parallel to the geometric roller axes 9 and 10. The pin 29 is disposed above the metering roller 6 (FIG. 1) and protrudes beyond the guide surface FL of the sealing support bracket 3 (FIG. 3). The pin 29, simultaneously, forms a limiting stop for the sealing element 2 when it is turned into the make-ready position for removal (note FIG. 5).

Moreover, in order to be able to remove the sealing support bracket 3 completely, for example, for the purpose of cleaning it, there has been provided on the sealing support bracket 3, as a construction feature, a bearing bracket or hook 30 for cooperation with the pin 29 on which the sealing support bracket 3 bears. The bearing bracket 30 has a downward-opening mouth defined by divergent flanks or sides 31 deriving from a basic hook profile. These flanks or sides 31 have a position-centering effect.

The sealing support bracket 3, which is accommodated in a relatively narrow gap Sp between the end faces of the metering roller 6, the dampening applicator roller 7 and the inner side of the lateral part 8 of the dampening unit F, is acted upon by a contact pressure spring 32 in an axial direction. The spring 32 is accommodated in a pressure member 33 having a somewhat flattened, arcuate top surface 34 which applies pressure continuously to the sealing support bracket 3 on the side thereof facing away from the guide surface FL of the sealing element 2 (in this regard, note FIG. 3, especially).

A suitable lateral offset of the pin 29 of the sealing support bracket 3 with respect to the channel 5 leaves an adequately free space above the channel 5 for accessibility by the sealing element 2.

An angle portion 35 on the sealing support bracket 3 is not only advantageous with respect to the manipulation of the sealing support bracket 3 in order to remove it, but also prevents the sealing support bracket 3 from swivelling so far downwardly about the pin 29 that it can be grasped only with great difficulty, for example when the sealing element 2 is removed. Furthermore, the angle portion 35 is spaced from an upper side of the lateral part 8, however, during operation.

The position of the sealing support bracket 3 is operationally determined, on the contrary, by the sealing element 2, through the bracing thereof against the support projection 19. Because the sealing element 2 moves downwardly approximately in the direction of the arrow Pf during operation, due to the effects of wear, a predetermined movement of the sealing support bracket 3 also takes place.

In order to exchange the sealing element 2, pressure is applied to the security or safety number 20 against-the action of the leg 21' of the spring 21, approximately at the overlap projections 28. In the view of FIG. 4, the security member 20 is shown suitably subjected to the pressure. This may be performed manually by an operator. Due to the gap Z, which is formed (note FIG. 4), the sealing element 2 can be turned about the metering roller 6 and thus be swivelled out of the functioning position into the make-ready position for removal thereof. FIG. 5 shows the sealing element 2 after such a swivelling procedure, but, however, while the securing component 20 remains pressed down (it being noted that the respective hand of the operator applying the downward pressure in FIGS. 4 and 5 has been omitted). When the sealing device according to the invention is in the setting or phase position of FIG. 5, the sealing element 2 can be readily removed in an upward direction.

It is believed to be readily understood that a suitable sealing device is provided at both ends of the channel or duct 5, even if the sealing device is shown only at one end in the drawing.

With respect to sealing element 2, it is also of importance that it should have a region 18 of greater thickness formed above the channel or duct 5 on the side of the sealing element 2 facing towards the channel 5. In principle, this region 18 extends radially with respect to the metering roller 6. In the embodiment according to the invention, the bevel 2' merges directly into the region 18.

The region 18 is constructed with such an approximate width as to enclose the gripper extension 15. As a result thereof, the gripper extension 15, as well as the finger-insert channel 16 are easier to grasp; in addition, for example, a tool can be directly applied at one stage to the thicker region 18, in order to swivel out the sealing element 2. Not in the least, the region 18, extending up to the sealing area 17, also provides advantages with regard to the wear behavior of the sealing element 2.

I claim:

1. In combination with a dampening unit of an offset printing machine having a dampening-medium applicator roller and a metering roller in rolling engagement with one another, the rollers defining an upper wedge forming a duct for receiving a supply of dampening medium therein, each of the rollers having an axis and having an end face, and at least one lateral part adjacent said rollers, and a pin fixed on said lateral part of the dampening unit and extending parallel to the axes of the metering and application rollers and defining a swivel axis parallel to said rollers; a sealing device comprising a sealing support bracket swivellably mounted on said swivel axis and means for pre-stressing said sealing support bracket in a direction towards the end faces of the rollers, and a sealing element held by said sealing support bracket, said sealing element being in frictional engagement with the rollers and being sealingly supported radially on the metering roller and being in sealing engagement with the end face of the dampening-medium applicator roller, a sealing element exchange device including means defining a path wherein the sealing element is swivellable a given distance about the metering roller in a direction opposite a rotational direction of the metering roller and from a sealing position thereof into a make-ready position wherein said sealing element is removable from the sealing device, and means for selectively allowing said sealing element to be freely turned about the metering roller, in said path, said sealing support bracket being formed with a support projection located outside an area brushed by said sealing element on said swivelling path thereof, said swivel axis and said support projection, in said sealing position of said sealing element, being disposed with respect to said sealing element so as to define means actuated primarily by prevailing friction forces and by rotation of the dampening medium applicator roller and said metering roller for holding said sealing support bracket in said sealing position of said sealing element with a holding force transmitted by said sealing element onto said support projection so as to maintain said sealing element in said sealing position thereof.

2. The combination according to claim 1, wherein the sealing element is formed with a gripper extension.

3. The combination according to claim 1, wherein the sealing element is formed with a lateral surface, and including a displaceable security member having means for applying pressure to said lateral surface of the sealing element, said sealing element being in cooperative engagement with said displaceable security member.

4. The combination according to claim 3, wherein the lateral surface of the sealing element extends substantially tangentially to the circumference of the metering roller.

5. The combination according to claim 3, including a cam fixed in position with respect to the sealing device, and wherein said security member is a plate having a boundary edge forming a first wedge surface and a second wedge surface, said wedge surfaces being located opposite one another, said first wedge surface being in cooperative engagement with the lateral surface of the sealing element, and the second wedge surface being in cooperative engagement with said cam.

6. The combination according to claim 5, including means for applying spring pressure from below to said security member, said applied spring pressure acting substantially parallel to said first wedge surface which is in cooperative engagement with the lateral surface of the sealing element.

7. The combination according to claim 5, wherein said security member is formed with a receiving pocket, and means for allowing said security member to be displaced in a downward direction, said cam being received in said receiving pocket when said security member is displaced in said downward direction.

8. The combination according to claim 3, wherein said security member is formed with a receiving groove, and including a spring mounted on the lateral part of the dampening unit, said spring having a leg engaging in said receiving groove formed in said security member.

9. The combination according to claim 3, wherein said security member has at least one overlap projection in an upper region thereof, said overlap projection projecting beyond one of two lateral surfaces of said security member and extending over the lateral part of the dampening unit.

10. The combination according to claim 9, wherein said overlap projection projects beyond both lateral surfaces of said security member.

11. The combination according to claim 1, wherein the sealing support bracket is formed with a downwardly opening bearing hook, said bearing hook being in cooperative engagement with said pin bearing said sealing support bracket.

12. The combination according to claim 11, wherein said pin is disposed above the circumference of the metering roller, and said bearing hook is formed on a lateral end of said sealing support bracket facing towards the metering roller.

13. The combination according to claim 1, wherein the sealing support bracket for the sealing element is formed with a guide surface, and said pin projects beyond said guide surface.

14. The combination according to claim 1, wherein the sealing element is formed with a region of greater thickness above the duct, said region being on a side thereof facing towards the duct.

15. The combination according to claim 14, wherein said region of greater thickness extends, substantially radially with respect to the metering roller, beyond the sealing element, and forms a gripper extension.

16. In a dampening unit of an offset printing machine having at least one lateral part and, adjacent thereto, a dampening-medium applicator roller and a metering roller in rolling engagement with one another, the rollers defining an upper wedge forming a duct for receiving a supply of dampening medium therein, each of the rollers having an end face, a sealing device comprising a sealing support bracket mountable on the lateral part and means for prestressing said sealing support bracket in a direction towards the end faces of the rollers, and a sealing element held by said sealing support bracket, said sealing element being in frictional engagement with the rollers and being sealingly supported radially on the metering roller and being in sealing engagement with the end face of the dampening-medium applicator roller, a sealing element exchange device including means defining a path wherein the sealing element is swivellable a given distance about the metering roller in a direction opposite a rotational direction of the metering roller and from a sealing position thereof into a make-ready position wherein said sealing element is removable from the sealing device, a pin pivotally mounting said sealing support bracket on the lateral part about a swivel axis, said sealing support bracket being formed with a guide surface, and said pin projecting beyond said guide surface, and means for selectively allowing said sealing element to be freely turned about the metering roller, in said path, said sealing support bracket being formed with a support projection located outside an area brushed by said sealing element on said swivelling path thereof, said swivel axis, defined by said pin, and said support projection, in said sealing position of said sealing element, being disposed with respect to said sealing element so as to define means actuated primarily by prevailing friction forces and by rotation of the dampening medium applicator roller for holding said sealing support bracket in said sealing position of said sealing element with a holding force transmitted by said sealing element onto said support projection so as to maintain said sealing element in said sealing position thereof.

* * * * *